US010001133B2

(12) United States Patent
Doll et al.

(10) Patent No.: US 10,001,133 B2
(45) Date of Patent: Jun. 19, 2018

(54) LOW-CAVITATION IMPELLER AND PUMP

(71) Applicant: Sundyne, LLC, Arvada, CO (US)

(72) Inventors: Corey Mathew Doll, Lakewood, CO (US); Harold House Mays, Denver, CO (US)

(73) Assignee: SUNDYNE, LLC, Arvada, CO (US)

( * ) Notice: Subject to any disclaimer, the term of this patent is extended or adjusted under 35 U.S.C. 154(b) by 290 days.

(21) Appl. No.: 14/874,166

(22) Filed: Oct. 2, 2015

(65) Prior Publication Data

US 2017/0097008 A1 Apr. 6, 2017

(51) Int. Cl.

| | |
|---|---|
| ***F04D 29/22*** | (2006.01) |
| ***F04D 27/02*** | (2006.01) |
| ***F04D 29/28*** | (2006.01) |
| ***F04D 29/42*** | (2006.01) |

(52) U.S. Cl.

CPC ..... *F04D 29/2238* (2013.01); *F04D 27/02* (2013.01); *F04D 29/28* (2013.01); *F04D 29/426* (2013.01); *F04D 29/4206* (2013.01)

(58) Field of Classification Search

CPC ..... F04D 27/02; F04D 29/2238; F04D 29/28; F04D 29/4206; F04D 29/426

See application file for complete search history.

(56) References Cited

U.S. PATENT DOCUMENTS

| | | | | |
|---|---|---|---|---|
| 3,737,249 | A * | 6/1973 | Cooper | F04D 3/02 415/72 |
| 4,481,020 | A * | 11/1984 | Lee | B01D 19/0052 166/105.5 |
| 6,361,270 | B1 * | 3/2002 | Bennett | F04D 1/10 415/143 |
| 6,905,310 | B2 * | 6/2005 | Kawamoto | F04D 29/284 416/175 |
| 7,461,692 | B1 * | 12/2008 | Wang | B01D 19/0057 166/105.5 |
| 8,936,430 | B2 * | 1/2015 | Bassett | F04D 3/02 415/143 |
| 8,944,767 | B2 * | 2/2015 | Stoicescu | F04D 29/2277 416/175 |
| 8,998,582 | B2 | 4/2015 | Wait | |

FOREIGN PATENT DOCUMENTS

EP 0359445 A2 3/1990

* cited by examiner

*Primary Examiner* — Igor Kershteyn

(74) *Attorney, Agent, or Firm* — Stephen Y. Liu; James R. Gourley; Carstens & Cahoon, LLP

(57) ABSTRACT

A low-cavitation impeller for a centrifugal pump is provided. The impeller provides a smooth flow path from the inducer section through to the outlet section. Continuous main blades run from a leading edge at the inlet eye to a trailing edge at the impeller outlet, and continuous secondary blades run from a leading edge in the transition region to a trailing edge at the impeller outlet.

17 Claims, 3 Drawing Sheets

LOW-CAVITATION IMPELLER AND PUMP

BACKGROUND OF THE INVENTION

Technical Field

The present invention relates to an impeller for a centrifugal pump, in particular a combination axial and radial impeller that reduces cavitation and consequent damage during operation.

Background

Centrifugal pumps that utilize impeller blades are known in the art. Examples of centrifugal pumps and impeller blades can be seen in U.S. Pat. No. 8,998,582 and European Patent Application No. 89308869.0.

SUMMARY OF THE INVENTION

In one embodiment, a centrifugal pump impeller comprises: an axis of rotation; an inducer end opposite from an outlet end along the axis of rotation; at least two main blades; at least two secondary blades; wherein the inducer end comprises an inlet eye; wherein each main blade is a continuous ridge extending from a main blade leading edge to a main blade trailing edge; wherein each main blade leading edge is adjacent to the inlet eye and each main blade trailing edge defines a first radius of the outlet end; wherein each main blade follows a helical or spiral path around the inducer end from the main blade leading edge towards the main blade trailing edge, and wherein each main blade defines a continuous inducer channel between itself and an adjacent main blade; wherein each main blade comprises a transition region between the inducer end and the outlet end; wherein each main blade comprises a length on the outlet end that extends radially perpendicular from the axis of rotation, and a height that extends parallel to the axis of rotation; wherein each secondary blade is a continuous ridge extending from a secondary blade leading edge to a secondary blade trailing edge; wherein each secondary blade leading edge is disposed between two adjacent transition regions of each of two adjacent main blades; wherein each secondary blade trailing edge defines a second radius of the outlet end which is equal to the first radius of the outlet end; and wherein each secondary blade defines two outlet channels, wherein each outlet channel is defined by a first wall, a second wall and a floor that connects the first wall with the second wall, wherein the first wall of each outlet channel is one surface of a secondary blade and the second wall of each outlet channel is a surface of an adjacent main blade that faces the surface of the secondary blade defining the first wall, wherein the floor of each outlet channel is the surface of the impeller connecting the first wall to the second wall.

In another embodiment according to any other embodiment or combination of embodiments, each outlet channel comprises a balance hole in its floor. In another embodiment according to any other embodiment or combination of embodiments, the centrifugal pump impeller comprises four main blades and four secondary blades. In another embodiment according to any other embodiment or combination of embodiments, the centrifugal pump further comprises a radial cutout between each main blade trailing edge and each secondary blade trailing edge, wherein the radial cutout comprises a section of the impeller comprising a third radius which is less than the first radius and the second radius.

In another embodiment according to any other embodiment or combination of embodiments, each secondary blade is equidistant from each adjacent main blade from the secondary blade leading edge through to the secondary blade trailing edge.

In another embodiment according to any other embodiment or combination of embodiments, each secondary blade is geometrically similar to an adjacent main blade region.

In another embodiment according to any other embodiment or combination of embodiments, the transition region defines a continuous flow path between each inducer channel and the outlet end.

In another embodiment according to any other embodiment or combination of embodiments, each secondary blade comprises a length that extends radially perpendicular from the axis of rotation, and a height that extends parallel to the axis of rotation.

In another embodiment according to any other embodiment or combination of embodiments, the height of each secondary blade is equal to the height of each main blade.

In another embodiment, a centrifugal pump comprises an impeller embodying any feature or combination of features described herein.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

One embodiment of the present invention is an impeller configured for use with a centrifugal pump, and another embodiment is a centrifugal pump comprising an impeller. The inventive impeller can be described as a combination axial impeller and radial impeller (or a two-stage impeller) because it comprises an inducer section (or first stage) that imparts axial flow to the fluid being pumped, and an outlet section (or second stage) that imparts radial flow to the fluid.

Figure 1:
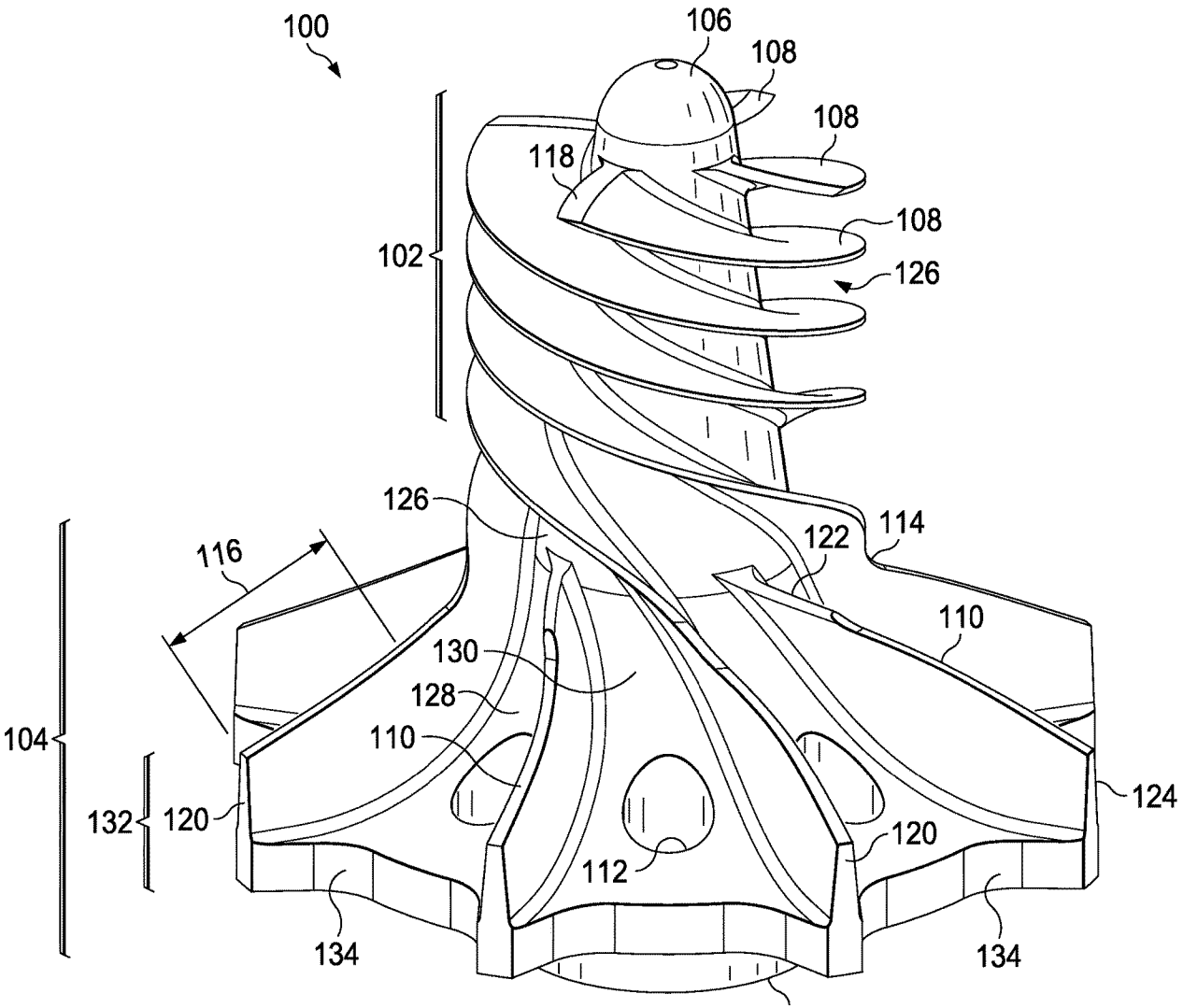
FIG. 1 is a perspective view of one embodiment of the impeller configured for use in a centrifugal pump.

FIG. 1 depicts a perspective view of one embodiment of the impeller of the present invention. The impeller 100 comprises an inducer end 102 and an outlet end 104. As the impeller spins around its axis of rotation, fluid enters the pump chamber of the centrifugal pump near the inducer end of the impeller at the eye 106, gets accelerated by the impeller blades, and exits the pump chamber into the volute casing of the pump surrounding the impeller.

The impeller of the present invention comprises main blades 108 (sometimes referred to as vanes), which are continuous ridges that run from the inducer end leading edge 118 to the outlet end trailing edge 120. On the inducer end 102, the main blades 108 run in a helical path or spiral path from the leading edge 118 around the axis of rotation towards the outlet end 104. In a section between the inducer end 102 and the outlet end 104 is a transition region 114 in which the main blades 108 transition from a helical or spiral path to an axial/radial path.

The result is that each main blade comprises a length 116 that extends radially, perpendicular to the axis of rotation of the impeller with a blade height 132 that is parallel to the axis of rotation, a transition section 114, and a section that is helical 102. The section 116 that is perpendicular to the axis of rotation extends from trailing edge 120 towards leading edge 118 and ends at one end of the transition section 114. The transition section 114 connects the helical or spiral inducer section 102 to the section 116 that is perpendicular to the axis of rotation.

Prior art designs for impellers, such as the one shown in U.S. Pat. No. 8,998,582, comprise a gap or discontinuity in the blade between the inducer section and the outlet section. One difference between the present invention and the prior art is that each main blade 108 on the present invention is a continuous ridge from the leading edge 118 to the trailing edge 120. Consequently, there is a continuous inducer channel or flow path 126 (which is split into two channels or flow paths by secondary blades 110, described in more detail below) from the leading edge of the inducer end to the transition section, and through to the outlet. This structure provides the fluid being pumped with a smooth transition from axial flow (flow in the axial direction) while in the inducer section to radial flow (flow in the radial direction) in the outlet section.

The impeller 100 of the present invention also comprises at least one secondary blade 110. Each secondary blade 110 comprises a trailing edge 124 that resembles the trailing edge 120 of the main blades 108. The secondary blade 110 comprises a ridge that extends from a trailing edge 124 to a leading edge 122. The leading edge 122 of each secondary blade 110 is located between the transition region 114 of each adjacent main blade 108. Each secondary blade comprises a length that extends radially from the axis of rotation of the impeller, and a height that extends parallel to the axis of rotation. In a preferred embodiment, this portion of the secondary blade is geometrically similar to each adjacent region of each adjacent main blade 108. Additionally, in one embodiment, each secondary blade is disposed on the impeller equidistant from each adjacent main blade.

Each secondary blade splits the continuous inducer channel 126 defined by the main blades that are on either side of the secondary blade into two continuous outlet channels 128 and 130. Each outlet channel is defined as the space between a secondary blade and an adjacent main blade, and each outlet channel extends from an area between the leading edge 122 of the secondary blade and circumferentially adjacent location on the adjacent main blade to an area between the trailing edge of the secondary blade and the trailing edge of the same main blade. Each outlet channel is defined by a first wall and a second wall, and a floor that connects the first wall to the second wall. The first wall comprises one surface of a main blade and the second wall comprises a surface of an adjacent secondary blade that faces the surface of the main blade that comprises the first wall. The floor is the surface of the impeller that connects the first wall with the second wall. One or both of outlet channels 128 or 130 may comprise a balance hole, as described below.

In a preferred embodiment, each outlet channel comprises a radial cutout 134 in the floor of the outlet channel. The radial cutout is a region where the outer edge at the outlet end of the impeller comprises a radius that is less than the radius of the impeller at the location of the trailing edge of the main blade or the trailing edge of the secondary blade. The radial cutouts help decrease axial load on the back side of the impeller, but cannot extend too far towards the axis of rotation or they will impact the structural integrity of the impeller blades.

In a preferred embodiment, the impeller comprises at least one balance hole 112. Balance holes help equalize the pressure on the front and back of the impeller shroud. Omitting balance holes can cause too much pressure to develop behind the impeller, which increases the axial thrust loads and increases the risk of a failed bearing.

Figure 2:
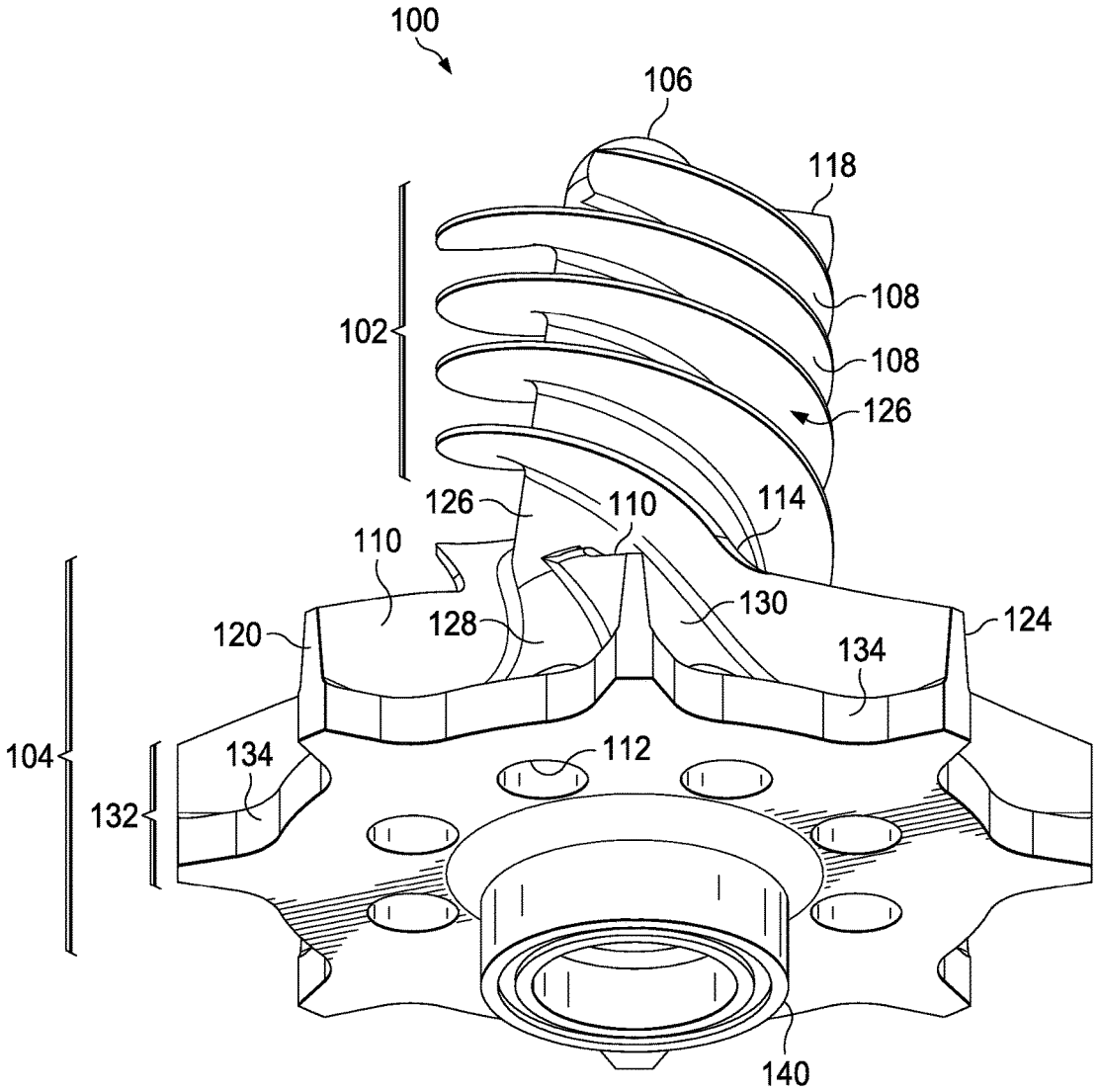
FIG. 2 is a different perspective view of the same embodiment of the impeller of the present invention.

FIG. 2 is a different perspective view of the impeller shown in FIG. 1, with the mounting assembly 140 visible. The mounting assembly 140 is used to affix the impeller to an actuating means, such as a crank shaft driven by a gear box, as described in detail below. The mounting assembly can mount the impeller using a keyway connection, spline connection, threaded connection, bolt & nut connection, or any other mounting assembly known in the art.

Figure 3:
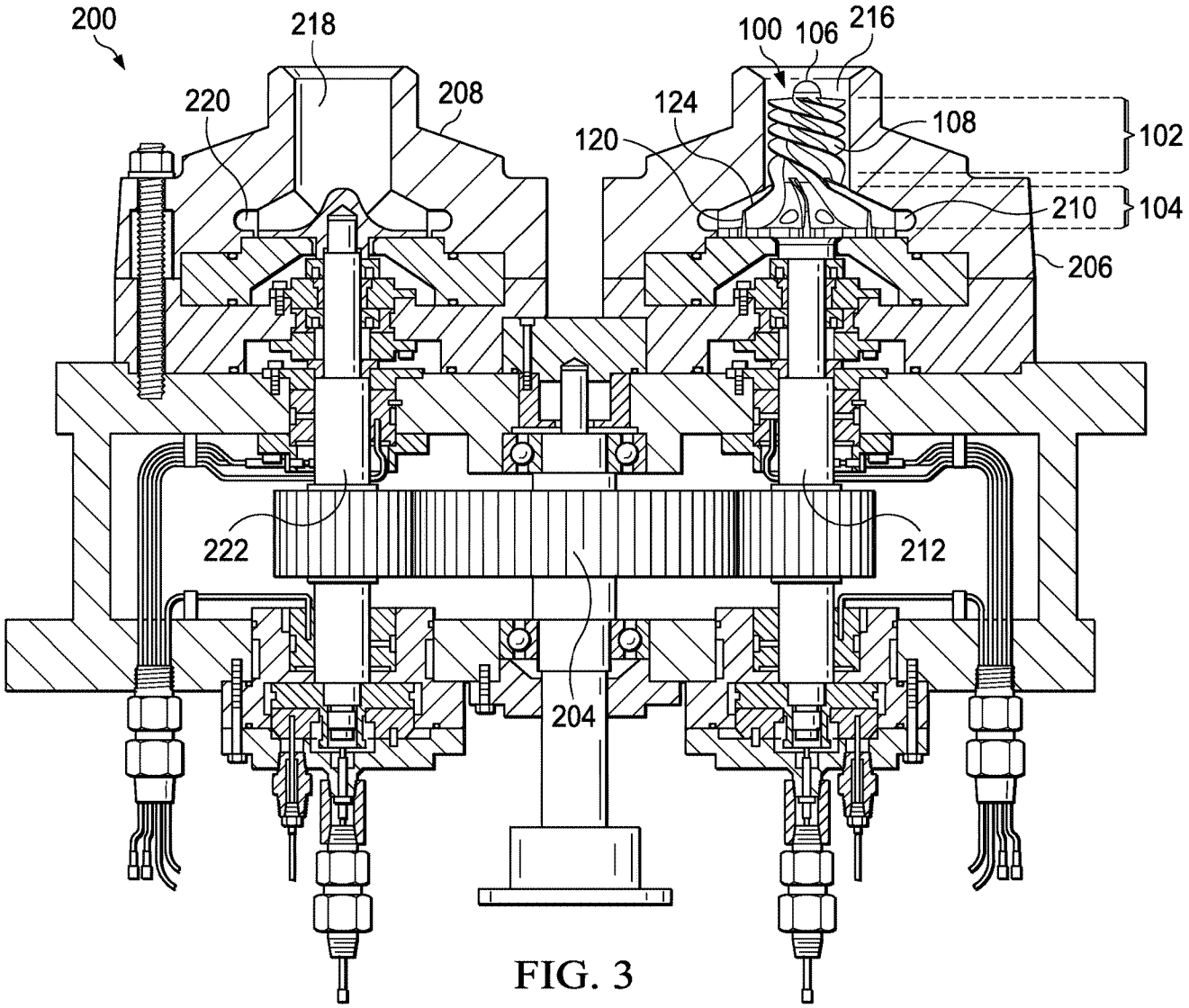
FIG. 3 is a cross-sectional view of a centrifugal pump comprising one embodiment of the impeller of the present invention.

FIG. 3 is a cross-sectional view of one embodiment of a two-stage centrifugal pump 200 comprising the one embodiment of the impeller of the present invention. The two stage pump comprises a first stage 206 a first inlet 216, which corresponds to the location of impeller eye 106. Fluid travels through inlet 216, through inducer section 102 and outlet section 104, and then flows into volute casing 210. The impeller is rotated about its axis of rotation by crank shaft 212 coupled to the impeller. Crank shaft 212 is turned by gear box 204.

Volute casing 210 is in fluid communication with a fluid outlet channel (not shown, extending towards the viewer of the cross-section in FIG. 3) which feeds the inlet 218 of the second stage 208 of the two-stage centrifugal pump 200. Fluid travels from the inlet through the second impeller and out through outlet volute casing 220. The second impeller is rotated about its axis of rotation by crank shaft 222, which is rotated by gear box 204. The second impeller is preferably not the inventive impeller described herein because the pressure at the inlet of the second stage inlet 218 is high enough that a conventional impeller can be used without causing cavitation or degradation of performance.

Although the embodiment shown in FIG. 3 is a two-stage centrifugal pump, the impeller of the present invention can be used in connection with virtually any centrifugal pump, such as a vertical single stage pump.

The primary advantage the inventive impeller described herein provides to a practitioner is a reduction in cavitation during operation of the pump. Cavitation is caused by localized flow separation and backflow that would cause uneven acceleration in the fluid and, consequently, the formation of a vapor cavity at the location of the pressure drop. When the pressure inside the pump renormalizes, the vapor cavity is repressurized and implodes, causing damage to the surface of the impeller near the implosion. This has been found to occur at the inlet eye of the impeller, and for the impeller disclosed in U.S. Pat. No. 8,998,582, at the leading edge of the radial blades comprising the outlet section, in the gap between the inducer blades and outlet blades.

Cavitation is a major problem in centrifugal pumps, and can occur even when the pump is designed with a correctly designed impeller and adequate amount of suction head. It is difficult to prevent or eliminate from a design once it is found to exist. Known ways of dealing with cavitation include modifying inlet case geometry, volute style, inducer design, rounding blade corners, or reducing the speed of the impeller. These conventional methods usually fail to eliminate cavitation in the eye of the impeller.

The present invention has been shown to substantially reduce or eliminate cavitation in the eye of the impeller, along the entire flow path of the impeller blades, and along the entire operating envelope of the pump, by not allowing recirculation, split flow, or backflow. In one embodiment, the inventive impeller can be sized to retrofit with existing pump designs, and can be easily interchanged with the impeller provided with the original equipment design. The inventive impeller can be retrofitted onto existing pumps and allow for up to 120% of rated flow or best efficiency point (BEP) without causing cavitation damage.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

What is claimed is:

1. A centrifugal pump impeller comprising:

an axis of rotation;

an inducer end opposite from an outlet end along the axis of rotation;

at least two main blades;

at least two secondary blades;

wherein the inducer end comprises an inlet eye;

wherein each main blade is a continuous ridge extending from a main blade leading edge to a main blade trailing edge;

wherein each main blade leading edge is adjacent to the inlet eye and each main blade trailing edge defines a first radius of the outlet end;

wherein each main blade follows a helical or spiral path around the inducer end from the main blade leading edge towards the main blade trailing edge, and wherein each main blade defines a continuous inducer channel between itself and an adjacent main blade;

wherein each main blade comprises a transition region between the inducer end and the outlet end;

wherein each main blade comprises a length on the outlet end that extends radially perpendicular from the axis of rotation, and a height that extends parallel to the axis of rotation;

wherein each secondary blade is a continuous ridge extending from a secondary blade leading edge to a secondary blade trailing edge;

wherein each secondary blade leading edge is disposed between two adjacent transition regions of each of two adjacent main blades;

wherein each secondary blade trailing edge defines a second radius of the outlet end which is equal to the first radius of the outlet end;

wherein each secondary blade defines two outlet channels, wherein each outlet channel is defined by a first wall, a second wall and a floor that connects the first wall with the second wall, wherein the first wall of each outlet channel is one surface of a secondary blade and the second wall of each outlet channel is a surface of an adjacent main blade that faces the surface of the secondary blade defining the first wall, wherein the floor of each outlet channel is the surface of the impeller connecting the first wall to the second wall, wherein each outlet channel comprises a balance hole in its floor.

2. The centrifugal pump impeller of claim 1 comprising four main blades and four secondary blades.

3. The centrifugal pump impeller of claim 1 further comprising a radial cutout between each main blade trailing edge and each secondary blade trailing edge, wherein the radial cutout comprises a section of the impeller comprising a third radius which is less than the first radius and the second radius.

4. The centrifugal pump impeller of claim 1 wherein each secondary blade is equidistant from each adjacent main blade from the secondary blade leading edge through to the secondary blade trailing edge.

5. The centrifugal pump impeller of claim 1 wherein each secondary blade is geometrically similar to an adjacent main blade region.

6. The centrifugal pump impeller of claim 1 wherein the transition region defines a continuous flow path between each inducer channel and the outlet end.

7. The centrifugal pump impeller of claim 1 wherein each secondary blade comprises a length that extends radially perpendicular from the axis of rotation, and a height that extends parallel to the axis of rotation.

8. The centrifugal pump impeller of claim 1 wherein the height of each secondary blade is equal to the height of each main blade.

9. A centrifugal pump comprising the impeller of claim 1.

10. A centrifugal pump impeller comprising:

an axis of rotation;

an inducer end opposite from an outlet end along the axis of rotation;

at least two main blades;

at least two secondary blades;

wherein the inducer end comprises an inlet eye;

wherein each main blade is a continuous ridge extending from a main blade leading edge to a main blade trailing edge;

wherein each main blade leading edge is adjacent to the inlet eye and each main blade trailing edge defines a first radius of the outlet end;

wherein each main blade follows a helical or spiral path around the inducer end from the main blade leading edge towards the main blade trailing edge, and wherein each main blade defines a continuous inducer channel between itself and an adjacent main blade;

wherein each main blade comprises a transition region between the inducer end and the outlet end;

wherein each main blade comprises a length on the outlet end that extends radially perpendicular from the axis of rotation, and a height that extends parallel to the axis of rotation;

wherein each secondary blade is a continuous ridge extending from a secondary blade leading edge to a secondary blade trailing edge;

wherein each secondary blade leading edge is disposed between two adjacent transition regions of each of two adjacent main blades;

wherein each secondary blade trailing edge defines a second radius of the outlet end which is equal to the first radius of the outlet end;

wherein each secondary blade defines two outlet channels, wherein each outlet channel is defined by a first wall, a second wall and a floor that connects the first wall with the second wall, wherein the first wall of each outlet channel is one surface of a secondary blade and the second wall of each outlet channel is a surface of an adjacent main blade that faces the surface of the secondary blade defining the first wall, wherein the floor of each outlet channel is the surface of the impeller connecting the first wall to the second wall; and a radial cutout between each main blade trailing edge and each secondary blade trailing edge, wherein the radial cutout comprises a section of the impeller comprising a third radius which is less than the first radius and the second radius.

11. The centrifugal pump impeller of claim 10 comprising four main blades and four secondary blades.

12. The centrifugal pump impeller of claim 10 wherein each secondary blade is equidistant from each adjacent main blade from the secondary blade leading edge through to the secondary blade trailing edge.

13. The centrifugal pump impeller of claim 10 wherein each secondary blade is geometrically similar to an adjacent main blade region.

14. The centrifugal pump impeller of claim 10 wherein the transition region defines a continuous flow path between each inducer channel and the outlet end.

15. The centrifugal pump impeller of claim 10 wherein each secondary blade comprises a length that extends radially perpendicular from the axis of rotation, and a height that extends parallel to the axis of rotation.

16. The centrifugal pump impeller of claim 10 wherein the height of each secondary blade is equal to the height of each main blade.

17. A centrifugal pump comprising the impeller of claim 10.

* * * * *